US009090106B2

(12) United States Patent
Taketsugu et al.

(10) Patent No.: US 9,090,106 B2
(45) Date of Patent: Jul. 28, 2015

(54) MEDIUM TRANSPORTING ROLLER AND RECORDING DEVICE

(71) Applicant: SEIKO EPSON CORPORATION, Tokyo (JP)

(72) Inventors: Eiji Taketsugu, Shiojiri (JP); Yosuke Nakano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 13/925,641

(22) Filed: Jun. 24, 2013

(65) Prior Publication Data

US 2013/0286130 A1 Oct. 31, 2013

Related U.S. Application Data

(63) Continuation of application No. 13/023,903, filed on Feb. 9, 2011.

(30) Foreign Application Priority Data

Feb. 10, 2010 (JP) ..... 2010-027337
Jan. 17, 2011 (JP) ..... 2011-007053

(51) Int. Cl.

| | |
|---|---|
| ***B41J 3/60*** | (2006.01) |
| ***B41J 13/00*** | (2006.01) |
| ***B41J 13/02*** | (2006.01) |
| ***B65H 27/00*** | (2006.01) |

(52) U.S. Cl.

CPC ..... *B41J 13/009* (2013.01); *B41J 13/02* (2013.01); *B41J 13/025* (2013.01); *B65H 27/00* (2013.01); *B65H 2402/80* (2013.01); *B65H 2404/1351* (2013.01); *B65H 2801/12* (2013.01)

(58) Field of Classification Search

CPC ..... B41J 13/009; B41J 11/0045; B41J 3/60
USPC ..... 347/104, 218; 400/648, 655, 662
See application file for complete search history.

(56) References Cited

U.S. PATENT DOCUMENTS

| | | | |
|---|---|---|---|
| 2,317,198 | A | 2/1940 | Kasper |
| 5,243,842 | A | 9/1993 | Kobayashi et al. |
| 5,461,464 | A | 10/1995 | Swain |
| 6,004,669 | A | 12/1999 | Rokutan et al. |
| 7,610,938 | B2 | 11/2009 | Yanokura et al. |

(Continued)

FOREIGN PATENT DOCUMENTS

| | | |
|---|---|---|
| JP | H8-277046 | 10/1996 |
| JP | 2001-063862 | 3/2001 |

(Continued)

OTHER PUBLICATIONS

Computer-generated translation of JP 2004-168534, published on Jun. 2004.*

*Primary Examiner* — Huan Tran
(74) *Attorney, Agent, or Firm* — Workman Nydegger

(57) ABSTRACT

In a recording device which performs recording on a recording medium, a transport driving roller which carries out transporting of the recording medium as a medium transport roller is formed by processing a plate member into a cylindrical shape. A bonding portion where the pair of edge portions of the plate material are bonded has a transport region, which is a region where at least the recording medium comes into contact with, extends in a straight line shape in a direction which intersects a circumference line.

8 Claims, 9 Drawing Sheets

(56) References Cited

U.S. PATENT DOCUMENTS

| | | | | |
|---|---|---|---|---|
| 7,614,738 | B2 * | 11/2009 | Takeuchi | 347/104 |
| 7,775,656 | B2 * | 8/2010 | Sugiyama et al. | 347/104 |
| 8,172,225 | B2 * | 5/2012 | Tanahashi | 271/225 |
| 8,240,655 | B2 * | 8/2012 | Samoto et al. | 271/3.19 |
| 8,390,898 | B2 * | 3/2013 | Mizutani | 358/440 |
| 8,517,371 | B2 * | 8/2013 | Horade | 271/10.11 |
| 8,696,109 | B2 * | 4/2014 | Ito et al. | 347/104 |
| 8,708,481 | B2 * | 4/2014 | Ito et al. | 347/104 |
| 2004/0047840 | A1 * | 3/2004 | Harper et al. | 424/93.4 |
| 2005/0058480 | A1 * | 3/2005 | Ohashi et al. | 400/55 |
| 2006/0268089 | A1 | 11/2006 | Takeuchi | |
| 2007/0002118 | A1 * | 1/2007 | Saito et al. | 347/104 |
| 2008/0205954 | A1 | 8/2008 | Sugiyama | |
| 2008/0240823 | A1 | 10/2008 | Asada | |
| 2008/0240824 | A1 | 10/2008 | Asada | |
| 2008/0298821 | A1 | 12/2008 | Mori | |
| 2009/0085949 | A1 * | 4/2009 | Sugiyama et al. | 347/16 |
| 2010/0044952 | A1 | 2/2010 | Harada | |
| 2010/0238475 | A1 * | 9/2010 | Mizutani | 358/1.12 |
| 2011/0156338 | A1 * | 6/2011 | Samoto et al. | 271/4.08 |
| 2011/0195828 | A1 * | 8/2011 | Taketsugu et al. | 492/28 |
| 2011/0267413 | A1 * | 11/2011 | Nakano et al. | 347/104 |
| 2012/0133719 | A1 * | 5/2012 | Toriihara et al. | 347/104 |
| 2012/0161387 | A1 * | 6/2012 | Horade | 271/225 |

FOREIGN PATENT DOCUMENTS

| | | | | |
|---|---|---|---|---|
| JP | 2001-158544 | | 6/2001 | |
| JP | 2002-059599 | | 2/2002 | |
| JP | 2002-127541 | | 5/2002 | |
| JP | 2003-089248 | | 3/2003 | |
| JP | 2004-151256 | | 5/2004 | |
| JP | 2004-168534 | * | 6/2004 | B41J 2/01 |
| JP | 2004-338928 | | 12/2004 | |
| JP | 2005-324559 | | 11/2005 | |
| JP | 2006-273449 | | 10/2006 | |
| JP | 2006-289496 | | 10/2006 | |
| JP | 2006-327793 | | 12/2006 | |

* cited by examiner

MEDIUM TRANSPORTING ROLLER AND RECORDING DEVICE

This application is a Continuation of application Ser. No. 13/023,903, filed Feb. 9, 2011, which is expressly incorporated herein by reference. The entire disclosure of Japanese Patent Application Nos. 2010-027337, filed Feb. 10, 2010, and 2011-007053 filed Jan. 17, 2011 are expressly incorporated by reference herein.

BACKGROUND

1. Technical Field

The present invention relates to a medium transporting roller, which carries out transporting of a recording medium such as paper in a recording device represented by a facsimile, a printer or the like, and a recording device provided with the medium transporting roller.

2. Related Art

In a recording device represented by a facsimile, a printer or the like, a transporting unit which transports a recording medium is provided in an upstream side of the recording unit which performs recording on a recording medium. As a configuration of a transporting unit, there is a transport belt and the like which transport while applying suction to a recording medium, but a configuration using a pair of rollers, which rotate while pinching a recording medium, is typical.

Furthermore, as a configuration of a roller, there is an elastic roller and the like which are formed from rubber or the like, but in ink jet printers in particular, a roller with a shaft shape is used where a high friction layer is formed on a surface of a metallic shaft as shown in JP-A-2001-63862 and JP-A-2001-158544. Here, the high friction layer is formed by holding abrasion resistant particles on an outer circumference surface of the shaft body using an adhesive layer and performs a function of improving a friction coefficient with the recording medium and preventing slipping.

In a case of using a roller with a shaft shape as a medium transporting roller, it is possible to select a solid shaft or a hollow (cylindrical) shaft. While rigidity is high and transport precision is high, a solid shaft results in higher costs and an increase in weight of the device. In regard to this, it is possible for a cylindrical shaft to contribute to reducing the weight of the device and lowering the cost.

Furthermore, the present applicants have proposed a cylindrical shaft structure shown in JP-A-2006-289496 as a structure of a cylindrical shaft. The cylindrical shaft described in JP-A-2006-289496 is a cylindrical shaft formed using a metallic plate material where a pair of opposing end portions has been joined, but a structure of a joining portion is configured as a shape with concavities and convexities (referred to in the specifications below as a "zigzag shape"), and according to this, mechanical joining strength is improved. Furthermore, the concavities and convexities which configure the zigzag shape are not simply concavities and convexities but are configured to join up similar to pieces in a so-called jigsaw puzzle by convexities where the width gets wider toward a top end and concavities which engage with the convexities so as to not easily separate when engaged.

However, while contributing to improving mechanical strength of the roller, the joining portion formed in the jigsaw shape has a negative effect in that it is easy for a front edge of a recording medium to get caught up when transporting the recording medium.

SUMMARY

An advantage of some aspects of the invention is that smooth transporting of a recording medium is secured when a cylindrical shaft is formed by processing of a plate body and is used as a medium transporting roller.

According to a first aspect of the invention, a medium transporting roller, which carries out transporting of a recording medium, is formed by processing a plate material into a cylindrical shape, and at least a region, which comes into contact with the recording medium, of a bonding portion, where a pair of edge portions of the plate material is bonded, extends in a straight line in an intersecting direction with regard to a circumference line.

According to the aspect, the medium transporting roller is formed in a cylindrical shape using a deformable plate material where a pair of opposing edge portions are bonded, but since at least the region of the bonding portion which comes into contact with the recording medium extends in a straight line in an intersecting direction with regard to the circumference line, that is, there is no complicated bonding configuration in the region which comes into contact with the recording medium, it is possible to reduce or prevent a front edge in particular of the recording medium from catching on an outer circumference surface of the medium transporting roller according to this and it is possible to secure smooth transporting.

According to a second aspect of the invention, in regard to the first aspect, the bonding section which extends in a straight line extends in a straight line shape in a direction which is not at a right angle with regard to the circumference line.

According to the aspect, since the bonding section which extends in a straight line extends in a straight line shape in a direction which is not at a right angle with regard to the circumference line, the bonding section with the straight-line shape forms a spiral shape in an outer circumference surface of the medium transporting roller. According to this, it is possible to prevent the front edge of the recording medium from being parallel to the bonding section with the straight-line shape and it is possible to reliably prevent the front edge of the recording medium from getting caught on the outer circumference surface of the medium transporting roller.

According to a third aspect of the invention, in regard to the first or second aspects, the bonding section has a concave and convex engaging portion using engaging of a concave portion and a convex portion which are formed in each of the edge portions, and the concave and convex engaging portion is arranged outside of the region which comes into contact with the recording medium.

According to the aspect, since the concave and convex engaging portion is arranged outside of the region which comes into contact with the recording medium, it is possible to prevent the front edge of the recording medium from getting caught on the concave and convex engaging portion (zigzag portion) in the outer circumference surface of the medium transporting roller and it is possible secure smooth transporting.

According to a fourth aspect of the invention, in regard to any of the first to the third aspects, the bonding portion has a matching portion formed using press processing and the matching portion is arranged outside of the region which comes into contact with the recording medium.

In a case where a straight line portion of an outer form of a product is punched out from a metallic plate material in press processing, since it is easy for positional deviation to occur, there are cases where a hole referred to as a matching is intentionally formed in the metallic plate material so that there is no positional deviation. When there is a desired plate material where a straight-line portion is punched out from a metallic plate material in press processing, the matching functions as an indication of the punch-out line so that it is possible to punch out the straight line portion as intended. Accordingly, since processing is performed accurately, bonding characteristics are improved when a pair of straight line portions is bonded together after press processing to make a cylindrical shaft and this contributes to smooth transporting of the recording medium as the medium transporting roller. However, a hole is segmented by press processing and becomes a concave portion, and since the concave portion forms a hole as a pair of concave portions when forming the cylindrical shaft, it is easy for the front edge of the recording medium to get caught here. Therefore, in the aspect, since the matching is arranged outside of the region which comes into contact with the recording medium, it is possible to prevent the front edge of the recording medium from getting caught on the matching portion formed in the outer circumference surface of the medium transport roller and it is possible to secure smooth transporting.

According to a fifth aspect of the invention, a recording unit, which performs recording on the recording medium, and the medium transporting roller according to any of the first to the fourth aspects, which carries out transporting of the recording medium, are provided. According to the aspect, it is possible to obtain an operational effect similar to any of the first to the fourth aspects in a recording device.

According to a sixth aspect of the invention, in regard to the fifth aspect, a shaft receiving portion which supports the medium transporting roller is arranged outside of a region where the concave and convex engaging portion of the third aspect, the matching portion of the fourth aspect, or the concave and convex engaging portion and the matching portion are provided.

There are cases where complicated configurations formed in the outer circumference surface of the medium transporting roller, that is, the concave and convex engaging portion and the matching portion, operate to hinder smooth sliding also with an inner circumference surface of the shaft receiving portion. Since the aspect arranges the shaft receiving portion outside the region where the concave and convex engaging portion and the matching portion are provided, it is possible to secure smooth sliding between the medium transporting roller and the shaft receiving portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
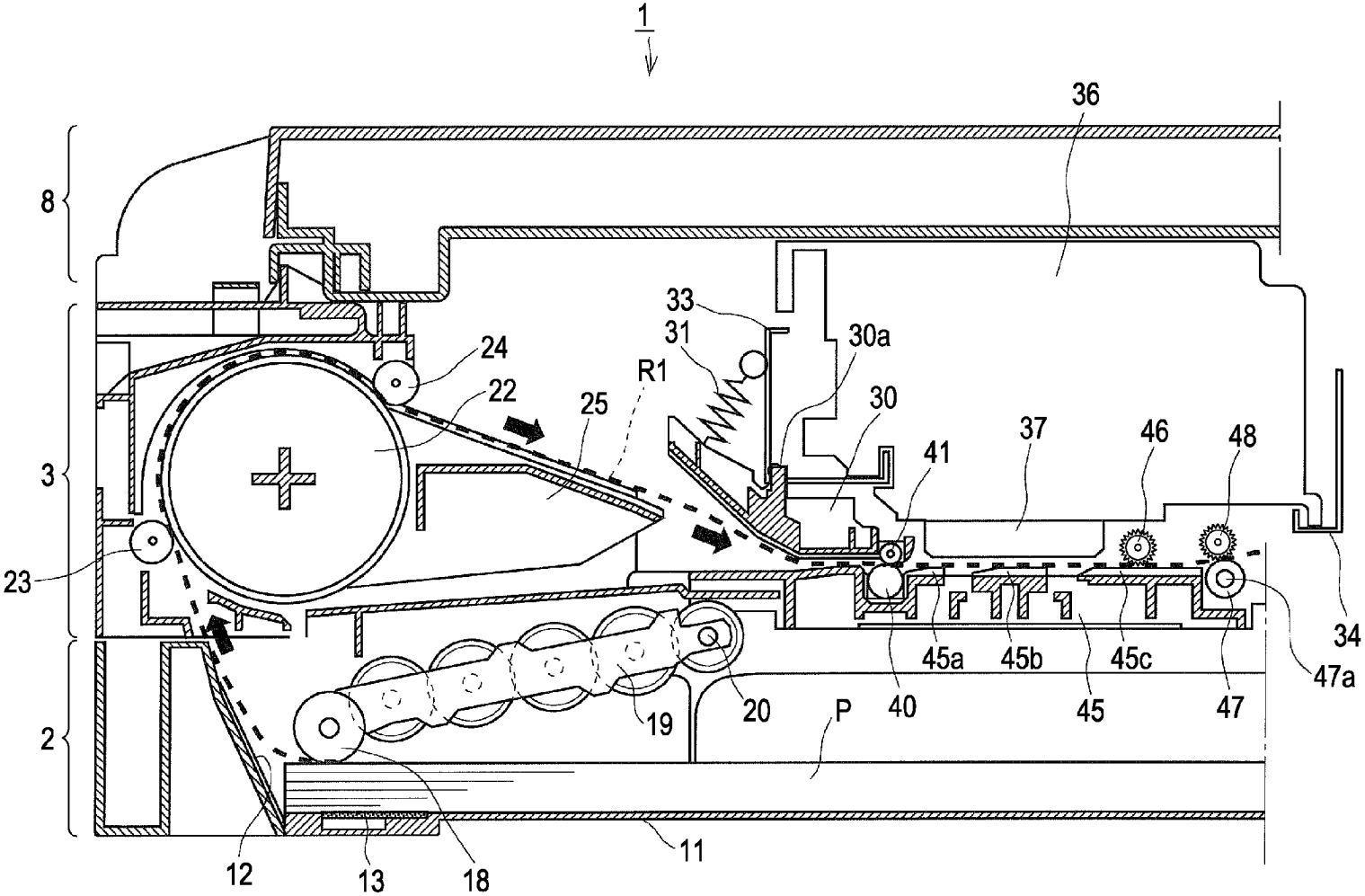
FIG. 1 is a side cross-sectional schematic diagram of a paper transporting path of a printer according to the invention.
Figure 2:
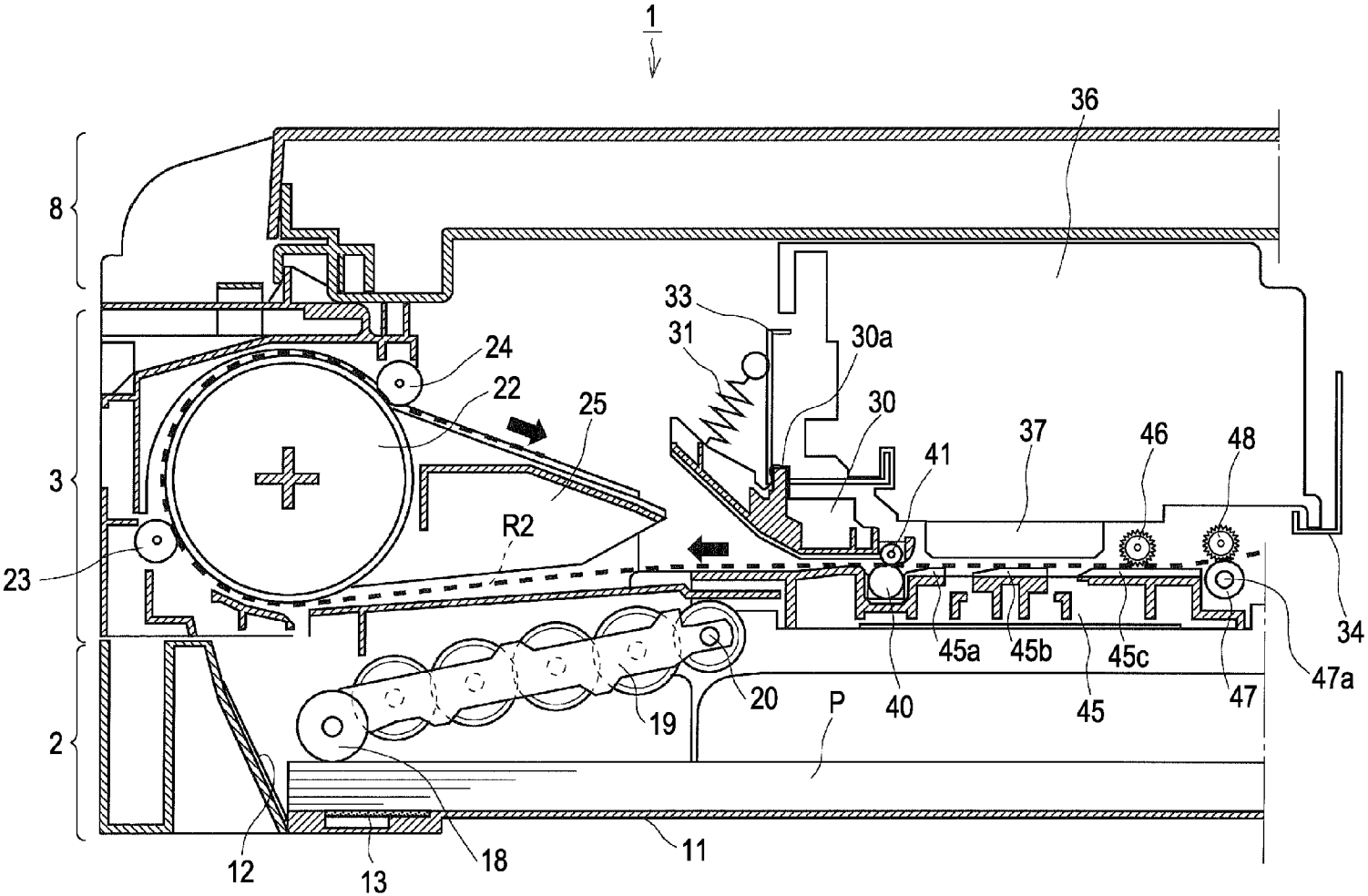
FIG. 2 is a side cross-sectional schematic diagram of a paper transporting path of a printer according to the invention.
Figure 3:
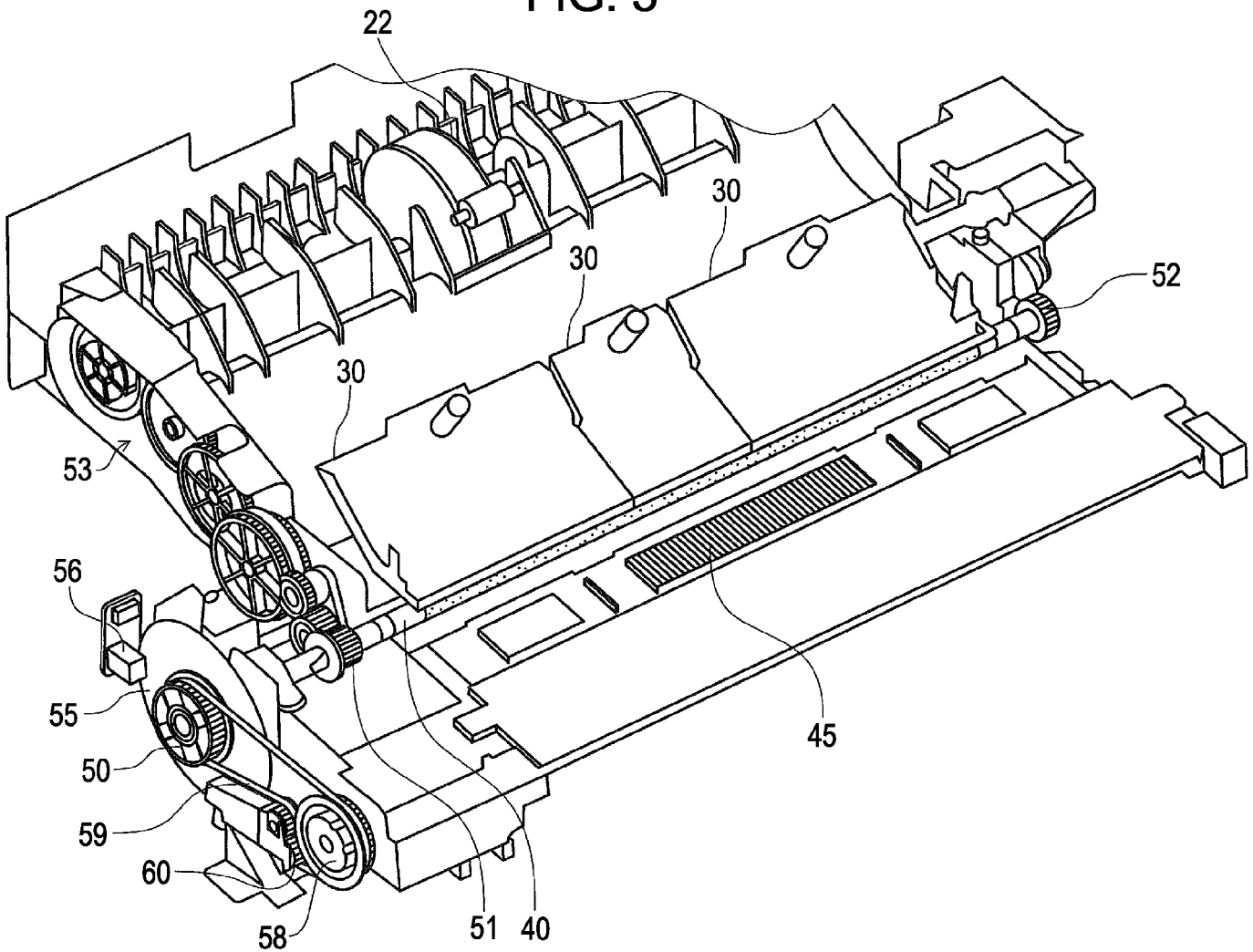
FIG. 3 is a perspective diagram of a device body of a printer according to the invention.
Figure 4:
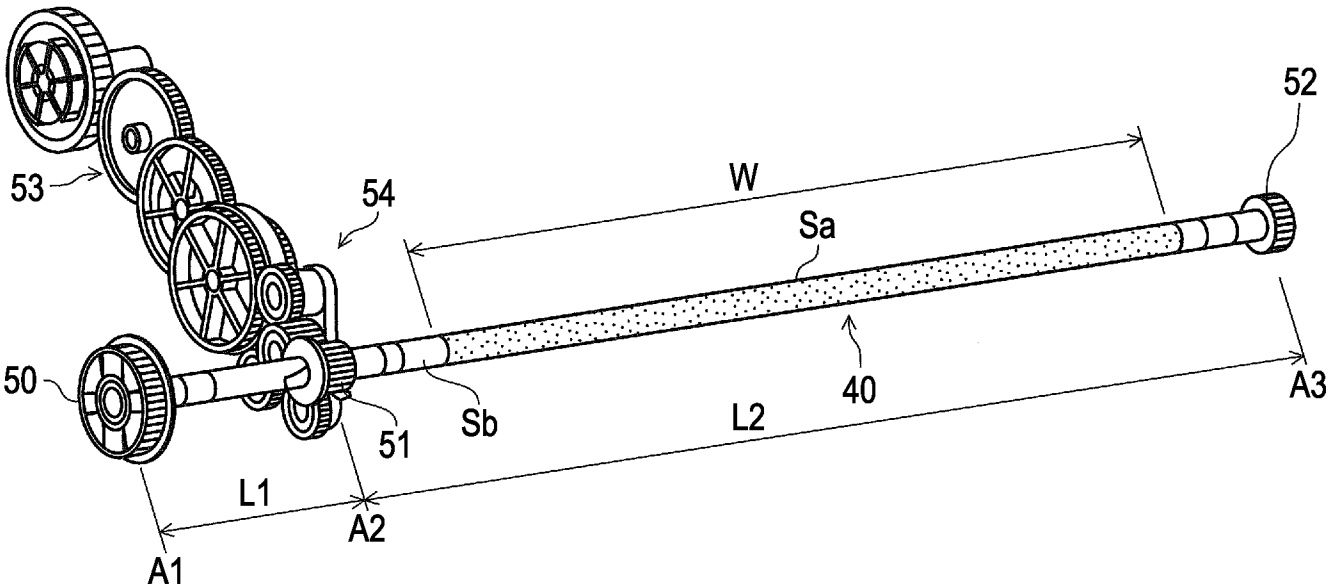
FIG. 4 is a perspective diagram of a power transmission system including a transport driving roller.
Figure 5:
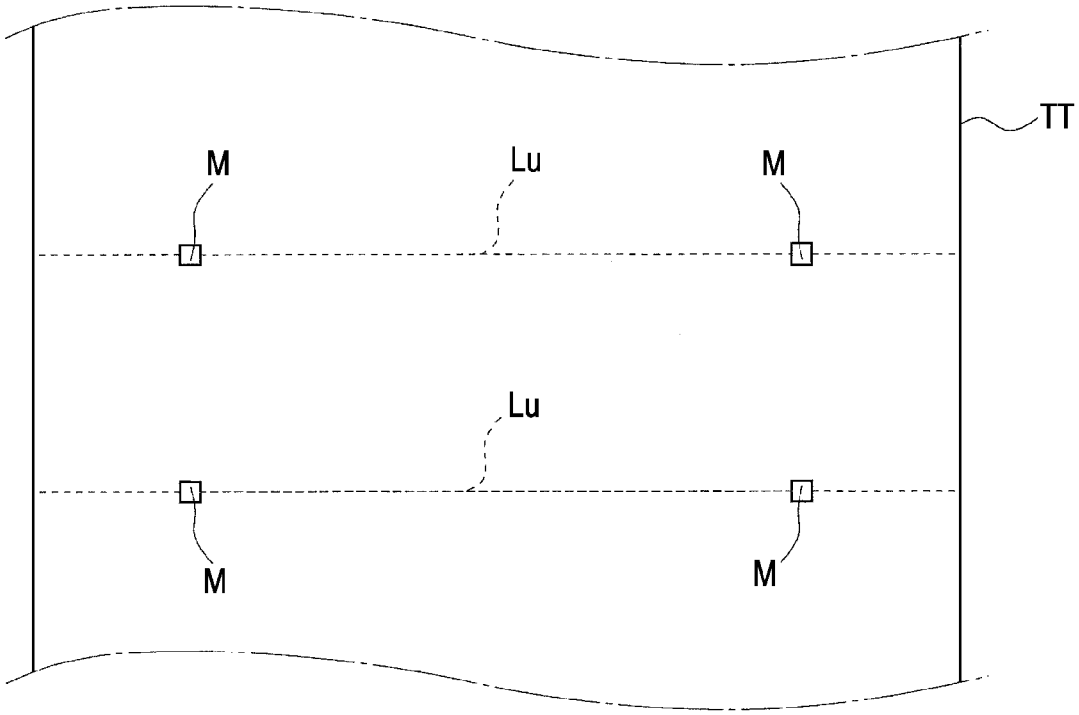
FIG. 5 is a planar diagram of a metallic plate material.
Figure 6A:
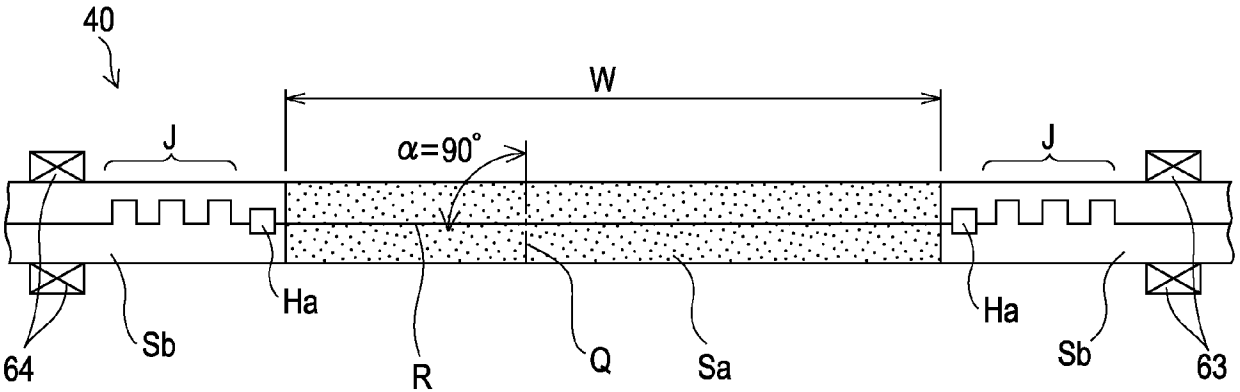
FIG. 6A is a planar diagram of a completed state of a transport driving roller and FIG. 6B is a planar diagram of a developing state before processing of a cylinder of the transport driving roller.
Figure 6B:
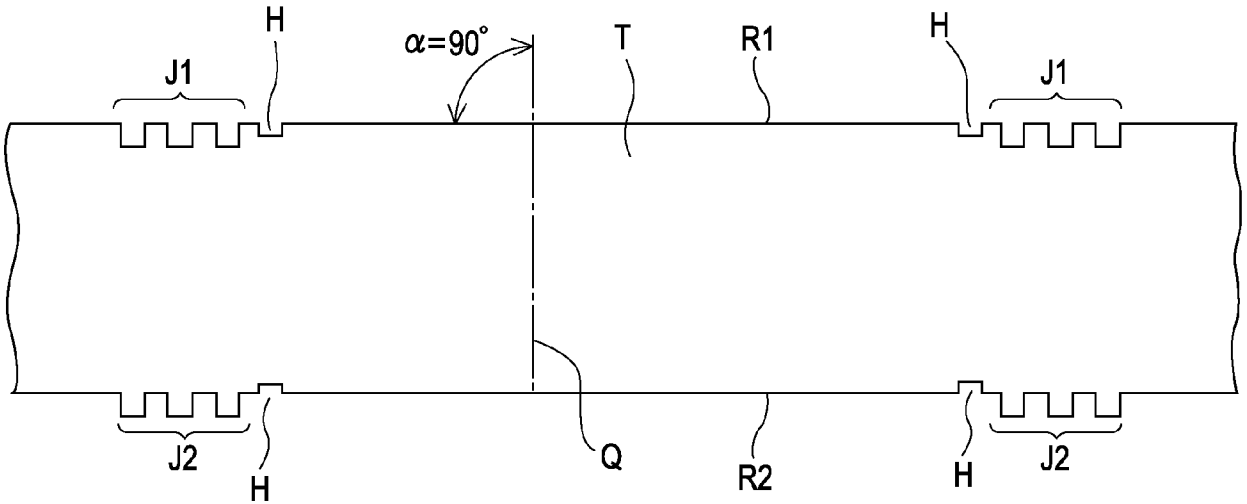
Figure 7A:
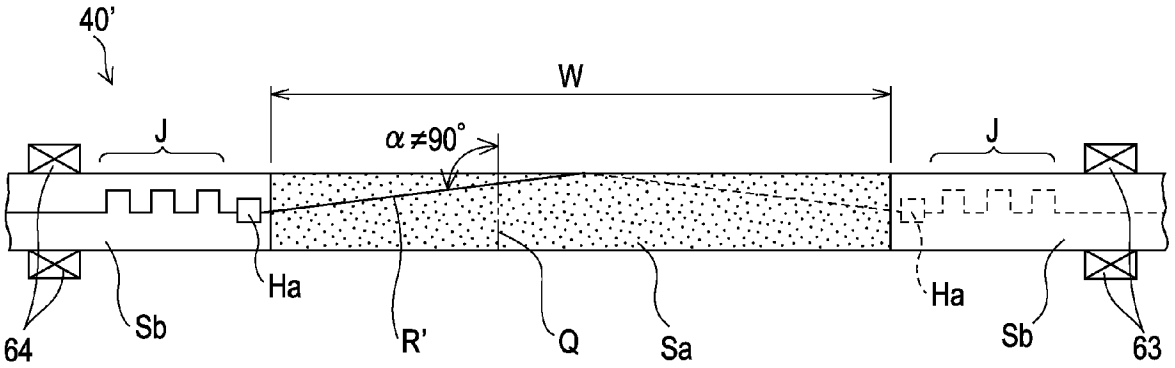
FIG. 7A is a planar diagram of a completed state of a transport driving roller according to another embodiment and FIG. 7B is a planar diagram of a developing state before processing of a cylinder of the transport driving roller.
Figure 7B:
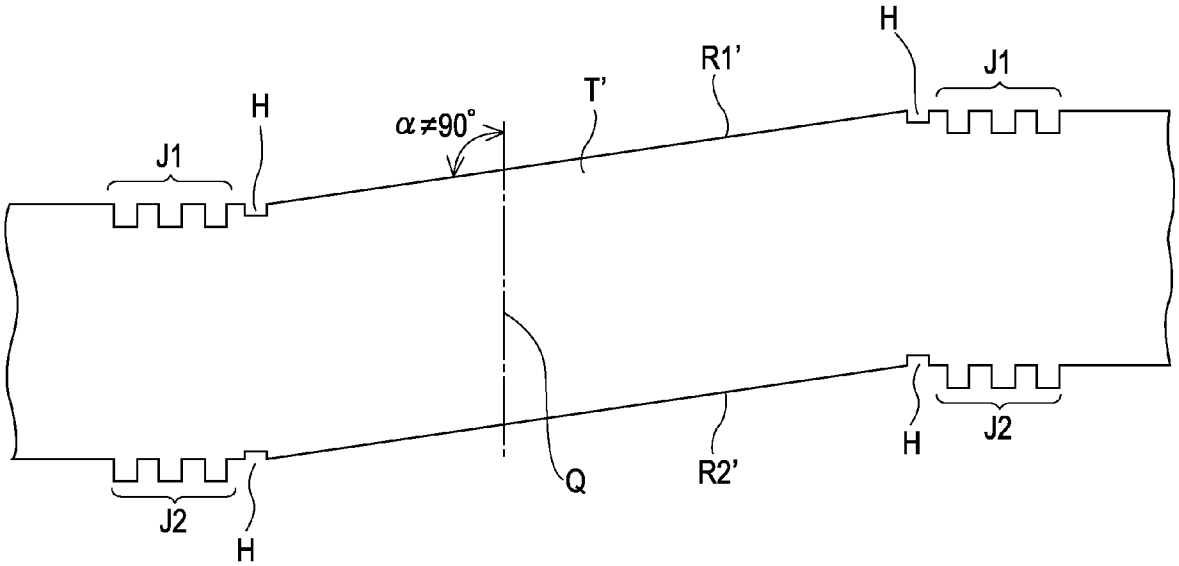

Below, an embodiment of the invention is described while referring to FIGS. 1 to 9C. Here, FIGS. 1 and 2 are side cross-sectional schematic diagrams showing a paper transporting path of an ink jet printer 1 as an example of a recording device according to the invention. FIG. 3 is a perspective diagram of a device body of the ink jet printer 1, FIG. 4 is a perspective diagram of a power transmission system including a transport driving roller 40. In addition, FIG. 5 is a planar diagram of a metallic plate material TT, FIG. 6A is a planar diagram of a completed state of the transport driving roller 40, FIG. 6B is a planar diagram of a developing state before processing of a cylinder of the transport driving roller 40, FIG. 7A is a planar diagram of a completed state of a transport driving roller 40' according to another embodiment, and FIG. 7B is a planar diagram of a developing state before processing of a cylinder of the transport driving roller 40'.

FIGS. 8A to 8C and FIG. 9A to 9C are side views illustrating a cylinder bending process using a press machine.

In addition, below, in a paper transporting path from a intermediate roller 24 to a discharge driving roller 47 in FIGS. 1 and 2, the right direction in the diagrams is referred to as a "downstream side" of the paper transporting path and the left direction in the diagrams is referred to as an "upstream side" of the paper transporting path.

1. Overall Configuration of Ink Jet Printer

In FIG. 1, the ink jet printer 1 is provided with a paper feeding portion 2 in a bottom portion of the device, and is provided with a configuration of performing recording by a recording paper P as an example of a recording medium being fed from the paper feeding portion 2, curved and reversed by a paper feeding roller unit 3, and supplied toward the recording unit (ink jet recording head 37) side. Here, the dashed line R1 in FIG. 1 shows the transport route (transit trajectory) of the recording paper P at this time.

In addition, the ink jet printer 1 is configured so that it is possible for, after recording on a first surface (front surface) of the recording paper P has been performed, the recording paper P to be fed back, sent to the paper feeding roller unit 3, reversed with a second surface (rear surface) on top, and transported again to the ink jet recording head 37 side. That is, the ink jet printer 1 is configured to be able to perform double-sided recording and the dashed line R2 in FIG. 2 shows the transport route (transit trajectory) of the recording paper P at this time.

The reference numeral 8 shows a scanning unit provided in an upper portion of a printer structure portion and the ink jet printer 1 is configured as a so-called multifunctional device where printing output of a document image read by the scanning unit 8 is possible using a lower portion of the printing structure portion.

Below, the structure of the paper transporting path will be further described. The paper feeding portion 2 is provided with a paper cassette 11 and a feeding roller 18. In the paper cassette 11 which is able to be attached and detached with regard to the body of the printer device, an edge guide which is not included in the diagram is provided, and using the edge guide, a side edge position and a rear edge position of the recording paper P accommodated in the paper cassette 11 are regulated.

A separating inclined surface 12 is provided in a position facing the front edge of the recording paper P accommodated in the paper cassette 11, and by the front edge of the recording paper P fed by the feeding roller 18 coming into sliding contact with the separating inclined surface 12 and being fed toward the downstream side, the uppermost recording paper P which is to be fed and the next recording papers P which are led to be fed together with the uppermost recording paper P are separated.

The feeding roller 18 is provided so as to be supported by an oscillating member 19 which is able to oscillate in the clockwise direction and the counterclockwise direction of FIGS. 1 and 2 centered around an oscillation shaft 20 and be rotatably driven by the power of a driving motor (not shown). When feeding paper, the feeding roller 18 sends out the uppermost recording paper P from the paper cassette 11 by coming into contact with the uppermost recording paper P accommodated in the paper cassette 11 and rotating.

In addition, a friction pad 13 is provided in the paper cassette 11 in a position facing the feeding roller 18, and when the feeding roller 18 presses the stack of paper from above, a function, where the stack of paper is held so that the whole stack of paper is not fed, is achieved by the lowermost recording paper P being pressed toward the friction pad 13.

The recording paper P fed upward from the paper cassette 11 enters the paper feeding roller unit 3. The paper feeding roller unit 3 is provided with a reversing roller 22, intermediate rollers 23 and 24, and a guiding member 25.

The reversing roller 22 is a roller with a large diameter which forms an inner side of a path for curving and reversing the recording paper P, and is positioned in a central position in the paper width direction (front and back direction in the paper surface of FIGS. 1 and 2) in the embodiment, that is, in one feeding standard position in the ink jet printer 1 according to the embodiment (refer to FIG. 3). The reversing roller 22 is provided so as to be rotatably driven by the power of a driving motor (not shown), and the recording paper P is transported to the downstream side by the reversing roller 22 being rotated in a clockwise direction of FIGS. 1 and 2.

The intermediate rollers 23 and 24 are freely rotatable rollers and by nipping the recording paper P with the reversing roller 22, assistance is provided to the paper feeding by the reversing roller 22. The guiding member 25 is positioned between the reversing roller 22 and the transport driving roller 40, and forms an upper-side path and a lower-side path which the recording paper P where recording has been performed on a first surface passes through when being back fed.

Next, in the downstream side of the intermediate roller 24, a first transporting unit is provided which is configured by being provided with the transport driving roller 40 and a transport driven roller 41. The transport driving roller 40 has abrasion resistant particles adhered to a surface of the shaft body which is long in a paper width direction of the embodiment and is rotatably driven by a driving motor (not shown). In addition, the transport driving roller 40 is formed from a hollow shaft where a metallic plate member is processed into a cylinder in the embodiment, but this will be described in detail afterwards.

In addition, the reference numeral Sa in FIGS. 4, 6A, 6B, 7A, and 7B shows a high-friction region which is formed by adhering the abrasion resistant particles, and the high-friction region Sa is a region (medium transporting region) which comes into contact with the recording paper P. In addition, the reference numeral W shows the formation range of the high-friction region Sa and the reference numeral Sb shows a low-friction region where the abrasion resistant particles are not attached.

Returning to FIGS. 1 and 2, the transport driven roller 41 is formed by a resin material in the embodiment and a plurality of the transport driven rollers 41 are arranged along a longitudinal direction of the transport driving roller 40. The transport driven roller 41 is supported so as to be able to freely rotate by the paper guiding member 30 as a roller supporting body, and the recording paper P is nipped between the transport driven roller 41 and the transport driving roller 40 by the transport driven roller 41 being provided to press against the transport driving roller 40.

The paper guiding member 30 which supports the transport driven rollers 41 is supported to be able to oscillate by a frame 33 via an oscillating shaft 30*a*, and the transport driven roller 41 is provided in a state of being urged in a direction to press against the transport driving roller 40 due to a tension spring 31 which exerts a urging force between the frame 33 and the paper guiding member 30.

As shown in FIG. 3, a plurality (three in the embodiment) of the paper guiding members 30 are arranged along a shaft line direction of the transport driving roller 40 in the embodiment. In the embodiment, the center paper guiding member 30 supports one of the transport driven rollers 41 and the paper guiding members 30 on both sides support two of the transport driven rollers 41.

In addition, the paper guiding member 30 carries out a function of guiding the recording paper P supplied from the upstream side to a nipping point between the transport driving roller 40 and the transport driven roller 41 as well as supporting the transport driven roller 41. Furthermore, when the recording paper P, where a trailing edge has separated from the nipping point between the transport driving roller 40 and the transport driven roller 41 toward the downstream side (right side in FIGS. 1 and 2), is back fed (when transported in the left direction in FIGS. 1 and 2), the paper guiding member 30 carries out a function of guiding the paper trailing edge to the nipping point between the transport driving roller 40 and the transport driven roller 41.

Next, in the downstream side of the transport driving roller 40, the ink jet recording head 37 and a paper guiding member 45 are arranged in an opposing manner in an up/down direction. The ink jet recording head 37 is provided in a bottom portion of a carriage 36 and is provided so as to receive power from a driving motor (not shown) and reciprocate in a main scanning direction (front and back direction in the paper surface of FIGS. 1 and 2) while being guided by frames 33 and 34 arranged before and after the carriage 36. In addition, an ink cartridge (not shown) is accommodated in the carriage 36.

In a surface which faces the ink jet recording head 37 in the paper guiding member 45, ribs 45*a*, 45*b* and 45*c* which extend in a paper transport direction are arranged in predetermined intervals on order from the upstream side of the paper transport direction toward the downstream side and a plurality of each rib is provided in appropriate intervals in the main scanning direction (arrangement in the main scanning direction is not shown). The recording paper P is supported by the ribs and the distance from the ink jet recording head 37 is regulated.

Next, in the downstream side of a region where the ink jet recording head 37 and the paper guiding member 45 are opposed, an auxiliary roller 46 is provided which prevents paper lifting, and further to the downstream side, the discharge driving roller 47 and the discharge driven roller 48 which configure a second transport unit are provided. The discharge driving roller 47 is configured by a rubber roller and is rotatably driven by a driving motor (not shown). The discharge driven roller 48 is a spur provided to come into light elastic contact with the discharge driving roller 47 and nips the recording paper P with the discharge driving roller 47.

Using the rollers, the recording paper P where recording has been performed is discharged toward a stacker (not shown).

In addition, the transport driving roller 40 is configured to be able to rotate forward and backward, that is, it is possible for the recording paper P to be transported in two directions; a first direction where the recording paper P is transported to the ink jet recording head 37 side (right direction: downstream side direction in FIGS. 1 and 2) and a second direction where the recording paper P is transported to the paper feeding roller unit 3 side which has a reverse path (left direction: upstream side direction in FIGS. 1 and 2). Furthermore, in the same manner, the discharge driving roller 47 is configured to be able to rotate forward and backward and it is possible for the recording paper P to be transported in either of the two directions, the first direction and the second direction, described above.

2. Power Transmission Configuration via Transport Driving Roller

Above is the configuration of the paper transporting path of the ink jet printer 1, and below, the power transmission configuration via the transport driving roller 40 as a transport roller will be described while referring to FIGS. 3 and 4.

The ink jet printer 1 according to the embodiment drives at least 4 driving targets, specifically the rollers of the feeding roller 18, the reversing roller 22, the transport driving roller 40, and the discharge driving roller 47, in the configuration shown in FIGS. 1 and 2 using one driving motor (not shown).

Out of the rollers, the feeding roller 18 is configured so that power is transmitted only during paper feeding using a power transmission switching unit (not shown), and the other three rollers (the reversing roller 22, the transport driving roller 40, and the discharge driving roller 47) are in a state of normally having power being transmitted during the recording execution period from at least from when the start of recording on the recording paper until when recording ends. That is, in the period excluding the recording execution period (during paper feeding), power is selectively transmitted from the motor to the feeding roller 18. In addition, the three rollers described above to which power is transmitted during the recording execution period are in a state of having power being transmitted from the motor during at least the recording execution period, but it is not limited to the rollers normally rotating, and of course, rotation stops in accordance with a stopping of the motor.

In FIG. 3, the reference numeral 60 shows a driving pulley attached to a rotation shaft of a motor, the reference numeral 50 shows a driven pulley attached to a shaft edge of the transport driving roller 40, and the reference numeral 58 shows a driven pulley attached to a shaft edge of a rotation shaft 47*a* of the discharge driving roller 47.

An endless belt 59 is wound around the driving pulley 60 and the driven pulleys 50 and 58, and according to this, the driven pulleys 50 and 58, that is the transport driving roller 40, and the discharge driving roller 47 are rotatably driven. In addition, the reference numeral 55 is an encoder scale which rotates integrally with the driven pulley 50, the reference numeral 56 is an encoder which detects rotation of the encoder scale 55, and according to this, it is possible to detect the rotation amount and the rotation speed of each of the rollers.

Next, the reference numeral 51 shows a first transmission gear attached to the transport driving roller 40. The first transmission gear 51 is a gear which transmits the power of a motor to a power transmission mechanism 53, and the power transmission mechanism 53 transmits the power obtained from the first transmission gear 51 to the reversing roller 22. In addition, the power transmission mechanism 53 includes a planetary gear train 54 (FIG. 4), and according to this, the reversing roller 22 is rotated in a normal rotation feeding direction (clockwise direction in FIGS. 1 and 2) irrespective of either normal rotation or reverse rotation of the transport driving roller 40.

Next, the reference numeral 52 shows a second transmission gear attached to an edge portion on a side opposite to one edge side of the transport driving roller 40 attached to the driven pulley 50. The second transmission gear 52 is a gear which transmits the power of a motor to the feeding roller 18 via a power transmission switching mechanism (not shown). In addition, the power transmission switching mechanism described above is provided to be able to engage with the carriage 36, and due to engagement and disengagement with the carriage 36, performs switching between a state of transmitting power to the feeding roller 18 and a state of not transmitting power.

Next, in FIG. 4, the reference numeral A1 shows a position (referred to below as a "first position A1") where the driven pulley 50 is attached in the shaft line direction of the transport driving roller 40. In addition, the reference numeral A2 shows a position (referred to below as a "second position A2") where the first transmission gear 51 is attached and the reference numeral A3 shows a position (referred to below as a "third position A3") where the second transmission gear 52 is attached. Furthermore, the reference numeral L1 shows the distance between the first position A1 and the second position A2, and the reference numeral L2 shows the distance between the second position A2 and the third position A3.

In the embodiment, as shown in the diagram, the first position A1, the second position A2, the high-friction region Sa (the region which comes into contact with the recording paper P), the third position A3 are arranged in this order from one side edge portion of the transport driving roller 40 toward to the other side edge portion in the shaft line direction of the transport driving roller 40.

According to this, the operational effects below are obtained. That is, in the embodiment, the transport driving roller 40 is formed by processing a metallic plate material into a cylindrical shape, that is, it is easy for distortions to occur due to shaft torque since it is a hollow shaft with lower rigidity than a solid shaft. Then, since the reversing roller 22, which is a driving target which operates by receiving power from a motor as a driving source via the transport driving shaft 40, operates by receiving power from the transport driving shaft 40 during the recording execution period from when the start of recording on one sheet of the recording paper P until when the recording ends as described above, there is a concern that the transport accuracy of the recording paper P will be reduced due to the distortion described above.

However, in the transport driving roller 40 of the embodiment, from the one side edge portion toward to the other side edge portion, the first position A1 where power is obtained from a motor, the second position A2 where power is transmitted to the reversing roller 22, and a transport region W where transport force is applied to the recording paper P are arranged in this order. As a result, it is possible to shorten the distance L1 between the first position A1 and the second position A2, it is possible to suppress the extent of the distortion which accompanies torque applied to the transport driving roller 40, and it is possible to suppress the reduction in paper transport accuracy which accompanies the distortion to be as small as possible.

In addition, in the transport driving roller 40 of the embodiment, from the one side edge portion toward to the other side edge portion, the first position A1 where power is obtained from a motor, the second position A2 where power is transmitted to the reversing roller 22, and the transport region W where transport force is applied to the recording paper P are arranged in this order, but the first position A1 and the second position A2 may be as per below.

That is, it is possible to arrange the first position A1, the second position A2, and the transport region W in this order from the one side edge portion of the transport driving roller 40 toward to the other side edge portion with a position where power is transmitted to the reversing roller 22 as the first position A1 and with a position where power is obtained from a motor as the second position A2. In this manner, since the position where the transport driving roller 40 transfers power to the reversing roller 22 is not arranged between the position where the transport driving roller 40 obtains power from a motor and the transport region W, it is possible that there is hardly any reduction in transport accuracy which accompanies the distortion of the transport driving roller 40.

3. Configuration and Manufacturing Method of Transport Driving Roller

Next, the configuration and the manufacturing method of the transport driving roller 40 will be described while referring to FIGS. 5 to 9C.

The transport driving roller 40 is formed by processing a metallic plate material into a cylindrical shape as described above, and mainly includes press processing of a metallic plate material, cylinder processing of the plate material obtained by the press processing, and a process of adhering the high-friction region Sa formed from abrasion resistant particles to a surface of the cylindrical shaft obtained by the cylinder processing. Below, a notch formation when performing press processing of the metallic plate material will be described. In addition, in regard to the cylinder processing, it is possible to adopt, for example, a processing method described in JP-A-2006-289496 described above.

In a case where a straight line portion of an outer form of a product is punched out from the metallic plate material in the press processing, since it is easy for positional deviation to occur, there are cases where a hole referred to as a matching M as shown in FIG. 5 is intentionally formed in the metallic plate material so that there is no positional deviation. When there is a desired plate material where a straight-line portion is punched out from the metallic plate material TT in the press processing, the matching M functions as an indication of the punch-out line Lu so that it is possible to punch out the straight line portion as intended. Accordingly, since processing is performed accurately, bonding characteristics are improved when a pair of straight line portions is bonded together after the press processing to make the cylindrical shaft and this contributes to smooth transporting of the recording medium as the medium transporting roller.

FIG. 6A is a planar diagram of the transport driving roller 40, the reference numeral R shows a bonding portion of the transport region W, and the reference numeral Q shows a circumference line (a theoretical line parallel with regard to the paper transport direction). In addition, the reference numeral J shows a zigzag portion and a reference numeral Ha shows a hole due to a pair of concave portions H. Then, the transport driving roller 40 is obtained by bending and processing a plate material T into a cylindrical shape as shown in FIG. 6B. In FIG. 6B, the reference numerals H show the concave portions, and the reference numerals R1 and R2 show a pair of edge portions (there are cases where the reference "edge surfaces" is used) of the plate material T which form the transport region W after the cylinder processing.

As shown in FIG. 6B, the edge portions R1 and R2 extend in a straight line so as to form a right angle ($\alpha$=90°) with regard to the circumference line Q and are formed by a smooth straight line with no concave and convex portions or the like being formed. According to this, as shown in FIG. 6A, the bonding portion R after cylinder processing also extends in a straight line so as to form a right angle ($\alpha$=90°) with regard to the circumference line Q and is formed of a smooth straight line with no concave and convex portions or the like being formed.

The pair of concave portions H formed during press processing becomes the hole Ha due to the pair of concave portions by the concave portions being opposed after cylinder processing and the hole Ha is positioned outside of the transport region W. Zigzag portions J1 and J2 are concave and convex engaging portions formed so as to increasing bonding strength, and one side edge portion of the plate material T is formed in a concave shape and the other side edge portion of the plate material T is formed in a convex shape so as to be engaged as the zigzag portion J during bonding. Due to the zigzag portion J, the transport driving roller 40 is formed so as to improve the distortion strength in particular after cylinder processing. However, the zigzag portion J is positioned outside of the transport region W in the same manner as the hole Ha due to the pair of concave portions H.

According to the embodiment in the manner above, it is possible for the transport driving roller 40 which is formed by processing the plate material T into a cylindrical shape to secure smooth transport due to it being possible for the bonding portion R where the pair of edge portions R1 and R2 of the plate material T are bonded to reduce or prevent the catching of the front edge of the paper on the outer circumference surface of the transport driving roller 40 since the transport region W where at least the paper comes into contact with extends in a straight line shape in a direction which intersects the circumference line Q and the hole Ha due to the pair of concave portions H and the zigzag portion J are formed outside of the transport region W.

In addition, it is also possible to secure smooth sliding with the inner circumference surface of the shaft receiving portion by the hole Ha due to the pair of concave portions H and the zigzag portion J being arranged outside of a region where the transport driving roller 40 is supported by shaft receiving portions 63 and 64 (FIG. 6A)

Next, the other embodiment will be described while referring to FIGS. 7A and 7B. A transport driving roller 40' shown in FIG. 7A has an appearance where a bonding portion R' which extends in a straight line extends in a direction which does not form a right angle ($\alpha \neq 90°$) with regard to the circumference line Q and extends in a spiral shape in the outer circumference surface. A pair of edge portions R1' and R2' of a plate material T' which forms the transport driving roller 40' extends in a straight line shape in a direction which does not form a right angle ($\alpha \neq 90°$) with regard to the circumference line Q as shown in FIG. 7B.

In addition, in the same manner as FIG. 6B, in FIG. 7B, the pair of concave portions H formed during the press processing becomes the hole Ha due to the pair of concave portions H by the concave portions H being opposed after cylinder processing and the hole Ha is positioned outside of the transport region W. Furthermore, in the same manner, the zigzag portions J1 and J2 formed by one side edge portion of the plate material T being formed in a concave shape and the other side edge portion being formed in a convex shape so as to be engaged as the zigzag portion J during bonding. The zigzag portion J is also positioned outside of the transport region W in the same manner as the hole Ha due to the pair of concave portions H.

By being formed in this manner, the hole Ha due to the pair of concave portions H and the zigzag portion J are formed outside of the transport region W and the bonding portion R' is not parallel with regard to the front edge of the paper, and according to this, it is possible to more reliably prevent the front edge of the paper from catching on the outer circumference surface of the roller.

In addition, it is desirable if the bonding portion R' rotates with regard to the transport region W within one rotation in the direction of the circumference line Q, and furthermore, it is more desirable if the bonding portion R' rotates within half a rotation as shown in FIG. 6A.

If the bonding portion R' is formed in this manner, the front edge of the paper is prevented from catching on the outer circumference surface of the roller, it is easy for the plate material T' including the bonding portion R' to be punched out in the press processing, and it is possible to secure distortion rigidity.

Here, the manufacturing method of the transport driving roller 40 will be described. First, a process where the plate material T which is the base of the transport driving roller 40 is punched out of the metallic plate material TT using a press and a process where engaging portions are formed in the sheet material will be described. As shown in FIG. 5, the hole which is referred to as the matching M hole are formed in a plurality in the metallic plate material TT so as to become an indication of the punch-out line Lu when the plate material T is punched out of the metallic plate material TT using the press. Then, the matching holes M are set to the punch-out line Lu by the press and are punched out using the press. In this manner, the punch-out accuracy is improved when the plate material T is punched out of the metallic plate material TT. After that, the engaging portions J1 and J2 are formed in the plate material T by being punched out using the press as shown in FIG. 6B. This is to provide strength during bonding by the meshing of the zigzag portions J1 and J2 in cylindrical bending processing of the plate material T. The matching hole M and the zigzag portions J1 and J2 are formed as not to enter the transport region W as shown in FIG. 6A when forming the cylinder shaft by the cylindrical bending processing.

Next, the cylindrical bending processing of the plate material T will be described.

FIGS. 8A to 9C are side views illustrating cylinder bending processing using a press machine. A flat plate portion 70 of the plate material T is bent and processed so that the edge surfaces R1 and R2 which are edge surfaces of both sides of the flat plate portion 70 are brought closer together using a press. Then, as shown in FIGS. 8A to 9C, a cylindrical shape is formed by the pair of edge surfaces being opposed and brought together and the engaging portions J1 and J2 meshing together.

Figure 8A:
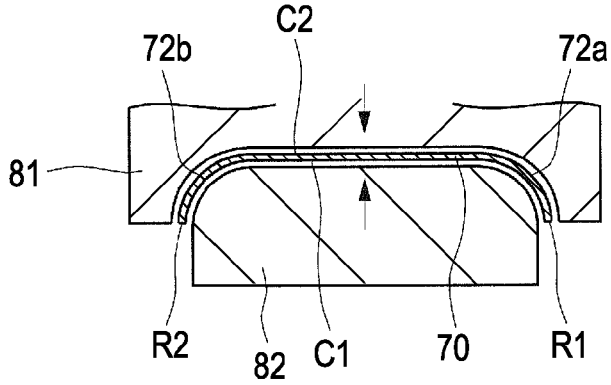
FIGS. 8A to 8C are side views illustrating cylinder bending processing using a press machine.

Specifically, first, the flat plate portion 70 of the plate material T is pressed by a female mold 81 (bending die) and a male mold 82 (bending punch) as shown in FIG. 8A, and both edge portions 72*a* and 72*b* of the flat plate portion 70 are bent into an arc shape (desirably approximately a ¼ arc). In addition, in order for each member to be easily understood in FIG. 8A, the members are shown with a gap opening out between the flat plate portion 70, the female mold 81, and the male mold 82, but the gap does not exist in reality and the flat plate portion 70, the female mold 81, and the male mold 82 are substantially in close contact in the respective contact portions. This is the same for FIGS. 8B to 9C described later.

Figure 8B:
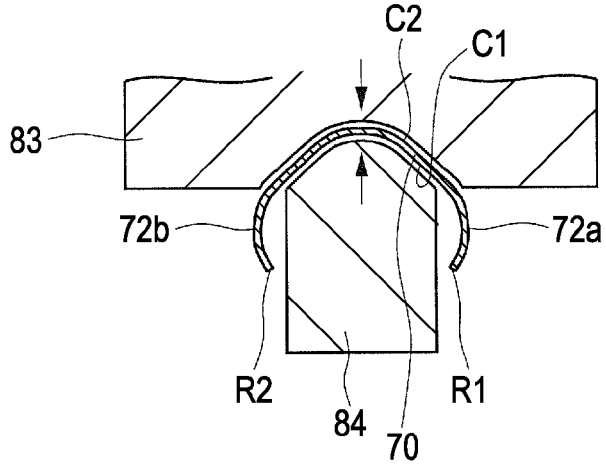
Figure 8C:
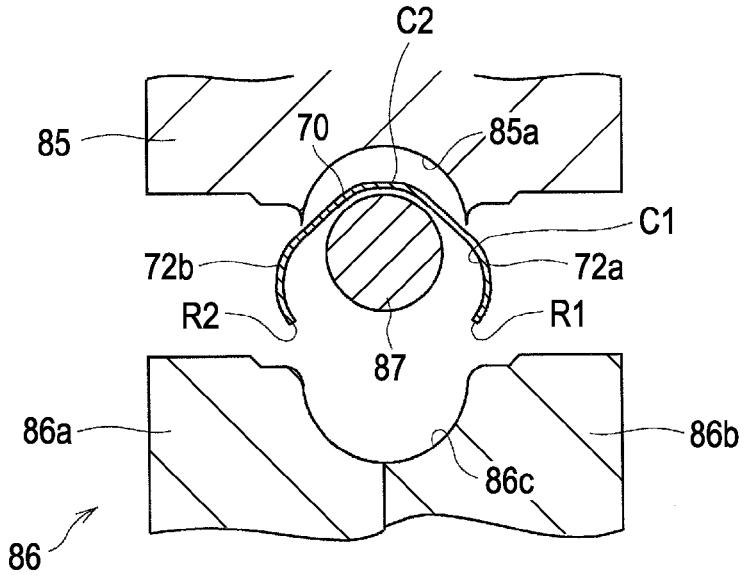

Here, the male mold 82 is arranged so as to face a surface of a lower side of the flat plate portion 70 in FIGS. 8A to 8C. In addition, the female mold 81 is arranged so as to face a surface of an upper side of the flat plate portion 70 in FIGS. 8A to 8C. According to this, the both edge portions 72*a* and 72*b* of the flat plate portion 70 are bent and processed in an arc shape toward a surface C1 side.

Next, after the plate material T is sent in one direction, a central portion in a short-side direction (bending direction) of the flat plate portion 70 is pressed by a second female mold 83 (bending die) and a second male mold 84 (bending punch) as shown in FIG. 8B. Then, the central portion of the flat plate portion 70 is bent into an arc shape (desirably approximately a ¼ arc) toward the surface C1 side.

Next, after the plate material T is sent in one direction, a core mold 87 is arranged at an inner side of the flat plate portion 70 as shown in FIG. 8C. Then, as shown in FIGS. 9A to 9C, each of the edge surfaces R1 and R2 of the both edge portions 72*a* and 72*b* of the flat plate portion 70 are brought closer together using an upper mold 85 and a lower mold 86 shown in FIG. 8C.

Figure 9A:
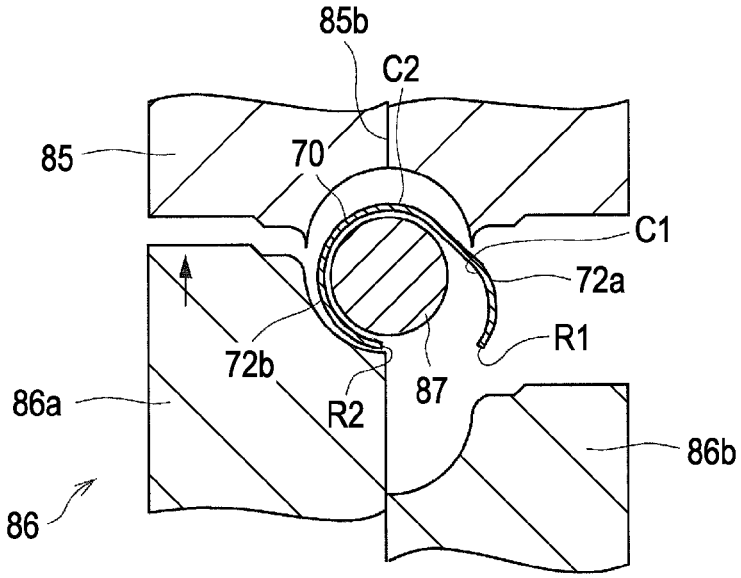
FIGS. 9A to 9C are side views illustrating cylinder bending processing using a press machine.
Figure 9B:
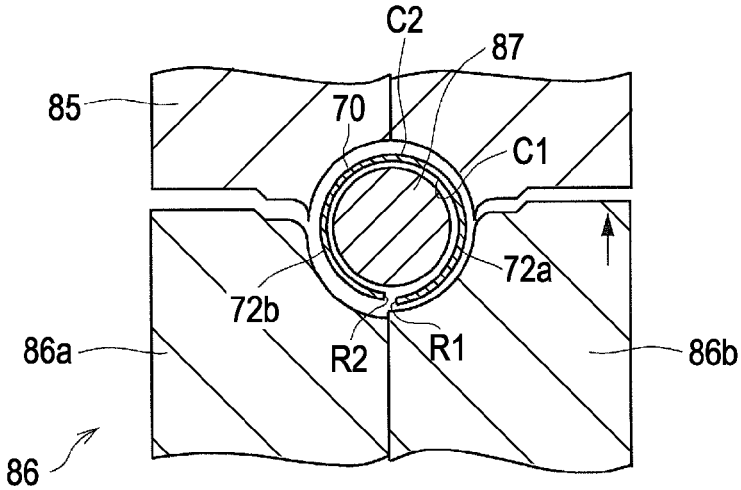
Figure 9C:
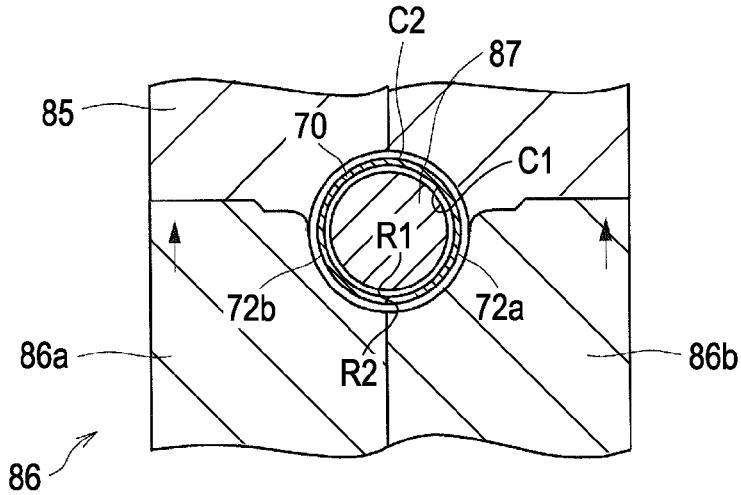

Here, the outer diameter of the core mold 87 shown in FIGS. 8C to 9C is equal to the inner diameter of the formed transport driving roller 40 with a hollow cylindrical shape. In addition, as shown in FIG. 8C, the radius of a press surface 86*c* of the lower mold 86 and the radius of a press surface 85*a* of the upper mold 85 are each equal to the radius of the outer diameter of the transport driving roller 40 when polishing has been factored in. Furthermore, as shown in FIGS. 9A to 9C, the lower mold 86 is a pair of left and right split molds, and the split molds 86*a* and 86*b* are configured to each be independent and able to rise and fall.

That is, from a state shown in FIG. 8C, the left-side split mold 86*a* is brought close to the upper mold 85 as shown in FIG. 9A, one side of the flat plate portion 70 is press processed and is bent into approximately a semicircle shape.

Here, the upper mold 85 may also be a left and right pair of split molds in the same manner as the lower mold 86 (refer to split surface 85*b*), and during the processing shown in FIG. 9A, the upper mold of the same side may be brought close to the split mold 86*a*.

Next, as shown in FIG. 9B, the core mold 87 is moved slightly to the upper mold 85 side (to an extent that it is possible that the one side edge surface R1 and the other side edge surface R2 are brought closer together), the other side split mold 86*b* is brought close to the upper mold 85, the other side of the flat plate portion 70 is press processed and bent into approximately a semicircle shape.

After that, as shown in FIG. 9C, the core mold 87 and the pair of split molds 86*a* and 86*b* are brought close to the upper mold 85 and the transport driving roller (hollow pipe) 40 with a cylindrical shape is formed. In this state, both the left and right sides of the edge surfaces R1 and R2 are in a state of opposing each other and being brought together.

That is, in the transport driving roller 40 with a cylindrical shape, the edge surfaces R1 and R2 of both sides of the flat plate portion 70 of the plate material T which is a substrate are brought close to each other and a joint is formed between the edge surfaces R1 and R2. Here, the surface C1 becomes an inner circumference surface of the transport driving roller 40 and a surface C2 becomes an outer circumference surface of the transport driving roller 40. In this manner, the flat plate portion 70 is wrapped around the core mold 87 and the transport driving roller 40 is formed by meshing the engaging portions J1 and J2. Here, the edge surfaces R1 and R2 are brought close to each other or come into contact and form the bonding portion R, and as a result of the meshing of the engaging portions J1 and J2, the zigzag portion J is formed as shown in FIG. 6A and contributes to the strength of the transport driving roller 40 and in particular improving of distortion strength.

Next, a process of adhering the high-friction region Sa formed from abrasion resistant particles shown in FIGS. 6A and 6B will be described.

As a method for adhering the high-friction region Sa, it is possible to adopt a dry method or a wet method (or a method using both of these), but in the embodiment, a drying method is appropriately adopted. Specifically, as a material for forming the high-friction region Sa, resin particles or inorganic particles are prepared. As the resin particles, fine particles are appropriately used which are formed from epoxy-based resin, a polyester-based resin, or the like.

As the inorganic particles, ceramic particles are appropriately used such as aluminum oxide (alumina; $Al_2O_3$), silicon carbide (SiC), or silicon dioxide ($SiO_2$). Among these, alumina is more appropriate to use since relatively higher rigidity and a function of increasing friction resistance is excellently exhibited as well as being relatively low in cost and not preventing a reduction in costs. Accordingly, in the embodiment, alumina particles are used as inorganic particles.

As the alumina particles, particles which have been regulated to a predetermined particle size distribution due to a crushing process are used. The edge portions of the alumina particles are relatively sharp due to being manufactured by the crushing process and exhibit a high frictional force due to the sharp edge portions.

When the resin particles and the inorganic particles have been prepared in this manner, first, the resin particles (not shown) described above are coated on the transport driving roller 40. That is, the transport driving roller 40 is arranged in a coating booth (not shown), and then, the transport driving roller 40 is given an (negative) electric potential in a state of being individual units.

Then, the resin particles are sprayed (ejected) toward and blown onto the transport driving roller 40 and the sprayed particles (resin particles) are statically charge with a high plus electric potential using a tribo gun of a static electricity coating device (not shown). Then, the statically charged resin particles are adsorbed on the outer circumference surface of the transport driving roller 40 and a resin film (not shown) is formed.

The transport driving roller 40 is moved to a different coating booth and while the transport driving roller 40 is rotated in a shaft rotation, due to the alumina particles described above being sprayed and blown from a corona gun (not shown), the alumina particles are selectively adsorbed due to static charge on the resin film formed on the transport driving roller 40. In the alumina particles being selectively adsorbed due to static charge on the resin film, masking of both edge portions of the transport driving roller 40 is performed using tape or the like in the same manner as the forming of the resin film. In this manner, the high-friction region Sa is adhered to the transport driving roller 40. Here, a frictional force can be exhibited by just the application of only the inorganic particles and it is sufficient to apply only the inorganic particles.

The embodiment described above is one example and it is possible to perform various modifications. In particular, the embodiment described above does not have the meaning that the invention is to provide all of the characteristic portions but the invention is possible with just either of the specific configurations of, for example, the power transmission mechanism shown in FIGS. 3 and 4 or the transport driving roller shown in FIGS. 5 to 7B.

In addition, in the embodiment described above, a hollow shaft is used as the transport driving roller 40 but the invention is not limited to a hollow shaft obtained by cylinder processing of a plate material as in the embodiment above, and it is possible to obtain the operational effect described above, in particular the operational effects of the power transmission mechanism described while referring to FIGS. 3 and 4, even with a hollow shaft obtained using a different manufacturing process. Furthermore, the operational effects of the power transmission mechanism described while referring to FIGS. 3 and 4 are not limited to the case where the transport driving roller 40 is a hollow shaft but it is possible to obtain the operational effects (reduction or prevention of distortions) even with a solid shaft.

What is claimed is:

1. A recording device, which performs recording on a recording medium, comprising:

a holding unit which holds the recording medium;

a feeding roller which feeds the recording medium from the holding unit;

a supporting member which supports the feeding roller and contacts with the feeding roller relative to the recording medium held on the holding unit by rotating around a shaft;

a reversing roller which reverses the recording medium fed from the holding unit;

a recording unit which has a recording head which discharges ink to the recording medium fed from the reversing roller in a recording region;

a guide path which guides the recording medium recorded by the recording unit toward the reversing roller through the recording region in a direction opposite to the feeding direction so as to reverse the recording medium; and a pair of transport rollers disposed across the guide path, wherein the pair of transport rollers transports the recording medium fed from the reversing roller toward the recording region and transports the recording medium recorded by the recording unit toward the reversing roller, the pair of transport rollers including a roller positioned on a lower side of the guide path, wherein the shaft of the supporting member is disposed below the guide path in a height direction of the recording device and disposed in a reversing roller side relative to the roller positioned on the lower side of the guide path.

2. The recording device according to claim 1, wherein at least a portion of the supporting member overlaps with the reversing roller in a horizontal direction of the recording device.

3. A recording device, which performs recording on a recording medium, comprising:

a holding unit which holds the recording medium;

a feeding roller which feeds the recording medium from the holding unit;

a supporting member which supports the feeding roller and contacts with the feeding roller relative to the recording medium held on the holding unit by rotating around a shaft;

a first path which includes a reversing path which reverses the recording medium fed from the holding unit;

a recording unit which has a recording head which discharges ink to the recording medium fed from the reversing path in a recording region;

a second path which guides the recording medium recorded by the recording unit toward the first path through the recording region in a direction opposite to the feeding direction so as to reverse the recording medium; and a pair of transport rollers disposed across the second path, wherein the pair of transport rollers transports the recording medium fed from the reversing path toward the recording region and transports the recording medium recorded by the recording unit toward the reversing path, the pair of transport rollers including a roller positioned on a lower side of the second path, wherein the shaft of the supporting member is disposed below the second path in a height direction of a recording device and disposed in a reversing path side relative to the roller positioned on the lower side of the second path.

4. The recording device according to claim 3, wherein at least a portion of the supporting member overlaps with the reversing path in a horizontal direction of the recording device.

5. A recording device, which performs recording on a recording medium, comprising:

a cassette which accommodates the recording medium;

a feeding roller which feeds the recording medium from the cassette;

a supporting member which supports the feeding roller and contacts with the feeding roller relative to the recording medium held on the cassette by rotating around a shaft;

a reversing roller which reverses the recording medium fed from the cassette;

a recording unit which has a recording head which discharges ink to the recording medium fed from the reversing roller in a recording region;

a guide path which guides the recording medium recorded by the recording unit toward the reversing roller through the recording region in a direction opposite to the feeding direction so as to reverse the recording medium; and a pair of transport rollers disposed across the guide path, wherein the pair of transport rollers transports the recording medium fed from the reversing roller toward the recording region and transports the recording medium recorded by the recording unit toward the reversing roller, wherein the pair of transport rollers includes a roller positioned on a lower side of the guide path, wherein the shaft of the supporting member is disposed below the guide path in a height direction of a recording device and disposed in a reversing roller side relative to the roller positioned on the lower side of the guide path.

6. A recording device, which performs recording on a recording medium, comprising:

a cassette which accommodates the recording medium;

a feeding roller which feeds the recording medium from the cassette;

a supporting member which supports the feeding roller and contacts with the feeding roller relative to the recording medium held on the cassette by rotating around a shaft;

a first path which includes a reversing path which reverses the recording medium fed from the cassette;

a recording unit which has a recording head which discharges ink to the recording medium fed from the reversing path in a recording region;

a second path which guides the recording medium recorded by the recording unit toward the first path through the recording region in a direction opposite to the feeding direction so as to reverse the recording medium; and a pair of transport rollers disposed across the second path, wherein the pair of transport rollers transports the recording medium fed from the reversing path toward the recording region and transports the recording medium recorded by the recording unit toward the reversing path, wherein the pair of transport rollers includes a roller positioned on a lower side of the second path, wherein the shaft of the supporting member is disposed below the second path in a height direction of a recording device and disposed in a reversing path relative to the roller positioned on the lower side of the second path.

7. The recording device according to claim 1, wherein the pair of transport rollers includes a roller positioned on an upper side of the guide path, wherein the reversing roller overlaps with the roller positioned on the upper side of the guide path of the pair of the transport rollers in a height direction.

8. The recording device according to claim 2, wherein the pair of transport rollers includes a roller positioned on an upper side of the guide path, wherein the reversing path overlaps with the roller positioned on the upper side of the guide path of the pair of the transport rollers in a height direction.

* * * * *